United States Patent [19]

Mechtold et al.

[11] Patent Number: 4,667,500

[45] Date of Patent: May 26, 1987

[54] FLARING DEVICE FOR PIPE ENDS

[75] Inventors: Helmut Mechtold, Nuremberg; Robert Weber, Uttenreuth, both of Fed. Rep. of Germany

[73] Assignee: Kraftwerk Union Aktiengesellschaft, Mülheim/Ruhr, Fed. Rep. of Germany

[21] Appl. No.: 706,047

[22] Filed: Feb. 27, 1985

[30] Foreign Application Priority Data

Mar. 5, 1984 [DE] Fed. Rep. of Germany ..... 3408070

[51] Int. Cl.[4] ..... B21D 3/10; B21D 41/00

[52] U.S. Cl. ..... 72/393; 72/399; 72/400

[58] Field of Search ..... 72/393, 399, 400, 370, 72/37; 269/48.1

[56] References Cited

U.S. PATENT DOCUMENTS

| | | | |
|---|---|---|---|
| 2,350,410 | 6/1944 | Murphy | 72/393 |
| 3,580,020 | 5/1971 | Bindernagel | 72/393 |
| 3,754,720 | 8/1973 | Gross et al. | 72/393 |
| 3,795,035 | 3/1974 | Pogonowski | 72/393 |
| 4,007,622 | 2/1977 | Galperin | 72/393 |
| 4,154,083 | 5/1979 | Rothenberger | 72/393 |
| 4,179,915 | 12/1979 | Huydts | 72/402 |

FOREIGN PATENT DOCUMENTS

| | | | |
|---|---|---|---|
| 47527 | 3/1983 | Japan | 72/370 |
| 138518 | 8/1983 | Japan | 72/342 |
| 215540 | 12/1983 | Japan | 72/37 |

*Primary Examiner*—Lowell A. Larson

*Attorney, Agent, or Firm*—Herbert L. Lerner; Laurence A. Greenberg

[57] ABSTRACT

A flaring device for pipe ends including an insert member centrally insertable into a pipe end, the insert member having mounted thereon synchronously operable pressure plungers arranged at the outer circumference thereof and bringable into engagement with the inner circumference of the pipe end to be flared, includes a calibrating ring for determining a maximum outer circumference defined by the pressure plungers mounted on the insert member, the calibrating ring being in operative engagement with the insert member.

23 Claims, 10 Drawing Figures

FLARING DEVICE FOR PIPE ENDS

The invention relates to a flaring device for pipe ends with a central insert member and with pressure plungers arranged at the outer circumference of the insert member, bringable into contact with the inner circumference of the pipe to be flared, and which are synchronously adjustable.

In welding thick-walled and brightly stressed pipes of large diameter (greater than 200 mm), as are used in power plant construction and often also in the chemical industry, it is absolutely necessary that the inner diameters of the pipe ends to be welded together should agree with one another exactly. This applies both to the overall diameter as well as to any possible out-of-roundness of both pipe ends. Joints in the interior of the pipe produced by edges thereof which are mutually offset lead not only to turbulence of the medium flowing therein, but also to deposition of impurities and to premature corrosion in these regions. Furthermore, such offset edges interfere with inspection and servicing with devices which are able to travel in the interior of the pipelines. It is much more important, however, that offset edges cause erroneous indications in ultrasonic testing, which cannot be differentiated from genuine defects which may be present. Because ultrasonic testing of the welded seam regions is forcibly prescribed in highly stressed pipes, however, the welding of pipe ends with edges which do not meet flushly is not permissible for this reason alone. In addition, the strength of a welded seam is negatively affected by the offset edges, however, because the danger exists that the bottom seam will not be fully welded, especially in automatic welding.

A flaring device for pipe ends has become known heretofore wherein four flaring jaws are pressable apart via a conical pressure plunger movable axially to the pipe. These flaring jaws respectively cover a fourth of the inner circumference of the pipe which is to be flared. Thick-walled pipe ends are also able to be flared with this device. This device is conceived of as a stationary machine and is not suitable for installation or assembly in situ because of the great weight and large dimensions thereof. Moreover, it is a peculiarity or characteristic of this device that it requires considerable experience on the part of the operating personnel to enlarge or widen a pipe to a given predetermined inner diameter. In this regard, not only the unavoidable spring-back depends also upon the kind of material of the pipe wall as well as upon the wall thickness. A result thereof is that the flaring must take place in several layers and must be remeasured repeatedly in-between. The remeasuring of out-of-round pipes is quite difficult and is possible only with an inner-circumference tape measure.

It is accordingly an object of the invention to provide a flaring device for pipe ends which produces defined circumferences during the flaring process and which breaks down the ovality of the cross section until a spring-back effect occurs. In addition, it is also an object of the invention to provide such a flaring device which is relatively easy to handle. A further object is to provide such a flaring device by which it is possible to effect a flaring of pipe ends up to a specific, predeterminable circumference rapidly and reliably. Moreover, it is an added object of the invention to provide such a flaring device in situ which is capable of being handled by one person.

With the foregoing and other objects in view, there is provided in accordance with the invention, a flaring device for pipe end including an insert member centrally insertable into a pipe end, the insert member having mounted thereon synchronously adjustable pressure plungers arranged at the outer circumference thereof and bringable into engagement with the inner circumference of the pipe end to be flared, comprising a calibrating ring for determining a maximum outer circumference defined by the pressure plungers mounted on the insert member, the calibrating ring being in operative engagement with the insert member.

In accordance with another feature of the invention, there are provided means for bringing the pressure plungers, at the outer circumference defined thereby, into direct contact with the calibrating ring, and with the inner circumferential surface of the pipe.

In accordance with a further feature of the invention, there are provided means for bringing the pressure plungers into contact with the inner surface of the pipe end to be flared and for bringing the calibrating ring into contact with the outer surface of the pipe end to be flared.

In accordance with an added feature of the invention, the calibrating ring comprises a washer having a circular outer shoulder formed thereon and projecting toward the pipe end.

In accordance with an additional feature of the invention, the calibrating ring has means for receiving therein insert rings of varying inner diameters.

In accordance with again another feature of the invention, there are provided means for fastening the calibrating ring on the insert member in centered relationship therewith.

In accordance with again a further feature of the invention, the calibrating ring has individually adjustable stops at the outer circumference thereof, the pressure plungers being disposed, respectively, opposite the stops and being engageable thereby.

In accordance with again an added feature of the invention, the stops comprise respective setscrews lockable by respective lock nuts.

In accordance with again an additional feature of the invention, the calibrating ring is mounted within the insert member, the pressure plungers being formed with projections, respectively, by which the pressure plungers are engageable with the calibrating ring.

In accordance with yet another feature of the invention, the calibrating ring is adjustable relative to the insert member so as to bring regions of the calibrating ring into contact with the projections at different radial distances from an axis of symmetry.

In accordance with yet a further feature of the invention, the projections are formed with respective shoulders engageable with an inner side of the calibrating ring.

In accordance with yet an added feature of the invention, the calibrating ring is formed with inner surfaces which are beveled in saw-tooth manner and are engageable with respective shoulders formed on the respective projections.

In accordance with yet an additional feature of the invention, the calibrating ring is formed with inner surfaces which are engageable with respective shoulders formed on the respective projections, the inner surfaces having an inner diameter which varies conically in axial direction, the calibrating ring being axially displaceable relative to the insert member.

In accordance with still another feature of the invention, the calibrating ring is formed with bores through which contact between the respective pressure plungers and the pipe and the calibrating ring, respectively, is observable.

In accordance with still a further feature of the invention, the pressure plungers form part of a piston adjustable in a respective hydraulic and pneumatic cylinder.

In accordance with still an added feature of the invention, the hydraulic and pneumatic cylinders, respectively, are arranged in star-shaped manner in the insert member.

In accordance with still an additional feature of the invention, there is provided a spring operatively engaging the pressure plungers for pressing the pressure plungers into a position having the least possible radial spacing from an axis of symmetry of the insert member.

In accordance with another feature of the invention, the pressure plungers in the respective cylinders are acted upon on both sides thereof.

In accordance with a further feature of the invention, there is provided a key for continually limiting the stroke of each of the respective pressure plungers, the key being adjustable through a slot formed in the respective pressure plunger transversely to a guide therefor and axially to the insert member.

In accordance with an added feature of the invention, there is provided at least another set of pressure plungers having a different height for expanding the range of application of the flaring device.

In accordance with an additional feature of the invention, the pressure plungers are of bipartite construction, the pressure plunger having a part thereof engageable with the pipe, the part of the pressure plunger being replaceable by another such part having a different height and contour, respectively.

In accordance with again another feature of the invention, the pressure plungers have outer surfaces and are curved cylindrically in accordance with the inner circumference of the pipe and of the calibrating ring, respectively.

In accordance with again an added feature of the invention, the pressure plungers in the insert member are inclinded towards the pipe by up to 10° with respect to a plane oriented perpendicularly to the pipe axis.

In accordance with again an additional feature of the invention, the pressure plungers have L-shaped outer surfaces, an inner shoulder of which is engageable with a surface of the pipe and an upper end face with the calibrating ring.

In accordance with yet another feature of the invention, the insert member is of hollow cylindrical construction.

In accordance with yet a further feature of the invention the insert member is formed with at least one gap 10 mm wide, and including a removable fitting member closing the gap.

In accordance with yet an added feature of the invention, the fitting member is positively locked in the gap, secured against radial displacement.

In accordance with yet an additional feature of the invention, the fitting member carries at least one of the pressure plungers, and the one pressure plunger is connectible to a supply line of the other of the pressure plungers.

In accordance with still another feature of the invention, the insert member comprises a plurality of assemblable segments which are mutually securable against radial displacement.

In accordance with still a further feature of the invention, the segments of the insert member are securable against mutual, axial displacement.

In accordance with still an added feature of the invention, the calibrating ring is of multipartite construction for threading it over a supply hose, the parts of the calibrating ring being positively connectible to one another in direction of motion thereof.

In accordance with a concomitant feature of the invention, the insert member has means for centrically fastening the insert member to a pipe-centering device inserted in the pipe end to be flared. The advantages attainable with the invention are in particular that, depending upon whether the calibrating ring is brought into contact with the outer circumference of the pressure plungers or with the outer circumference of the pipe end to be flared, the flaring can be performed selectively to a predetermined inner diameter or to a predetermined outer diameter. A result thereof is that less stringent requirements can be set with the supplier of the pipes as to the specified tolerances, and the pipes can therefore be procured less expensively.

The field of use of the flaring device can be extended considerably if the calibrating ring is constructed to accept insert rings with different inner diameters. In this case, different pipe apertures or widths, or flared dimensions and, when flaring or widening to a predetermined outer circumference, different pipe wall thicknesses can be covered with one and the same calibrating ring and a set of insert rings.

In the case of out-of-round pipe ends and pipes with nonuniform wall thickness, a centered flaring or widening can be achieved if the calibrating ring can be fastened, centered with the insert member, and this insert member in turn, can be fastened, centered again with a conventional pipe centering device, which is inserted into the pipe.

It is also possible to increase the field of application of a pipe flaring device which is conceived for larger pipe diameters by providing that the calibrating ring be supported in the interior of the insert member and the pressure plungers be bringable into engagement with the calibrating ring via extensions or projections.

This creates the condition for producing different flarings or widenings with one and the same calibrating ring. This is the case, especially, if regions of the calibrating ring with different radial spacings from the symmetry axis can be brought into engagement with the extensions or projections of the pressure plungers by adjusting the calibrating ring relative to the insert member. Alternatively, the stroke of each pressure plunger can also be limited gradually via a key or wedge-shaped stop pin which is adjustable through a longitudinal slot formed in the pressure plunger transversely to its guide and axially to the insert member.

An especially clean flaring shape is obtained if the pressure plungers in the insert member are arranged inclined to the pipe by up to 10° or to the limit of the static friction angle relative to a plane aligned perpendicularly to the pipe axis. Stepped impressions of the pressure plungers at the inner wall surface of the pipe are thereby avoided.

Other features which are considered as characteristic for the invention are set forth in the appended claims.

Although the invention is illustrated and described herein as embodied in a flaring device for pipe ends, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
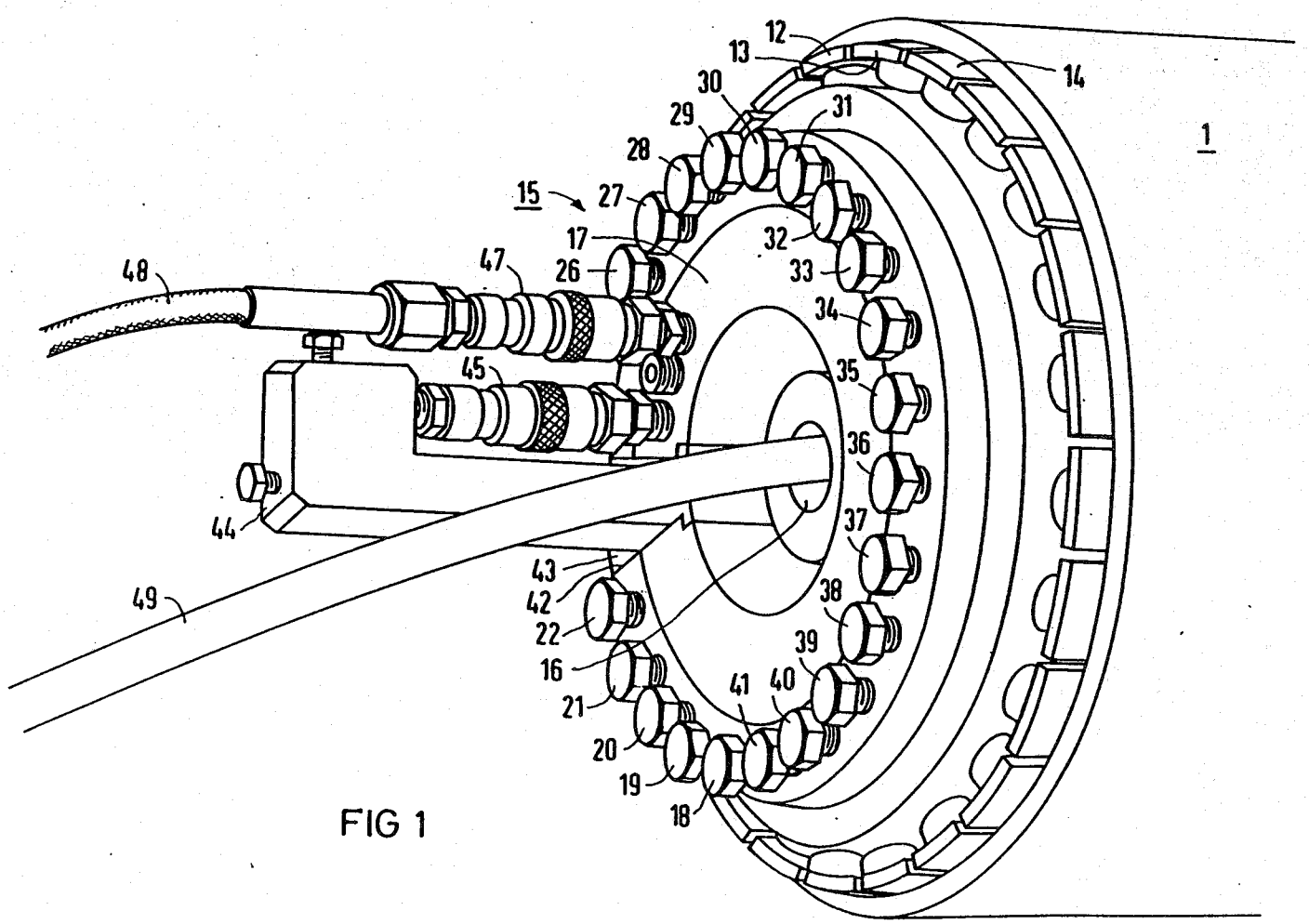
FIG. 1 is a perspective view of a flaring device according to the invention which is inserted into a pipe end.
Figure 2:
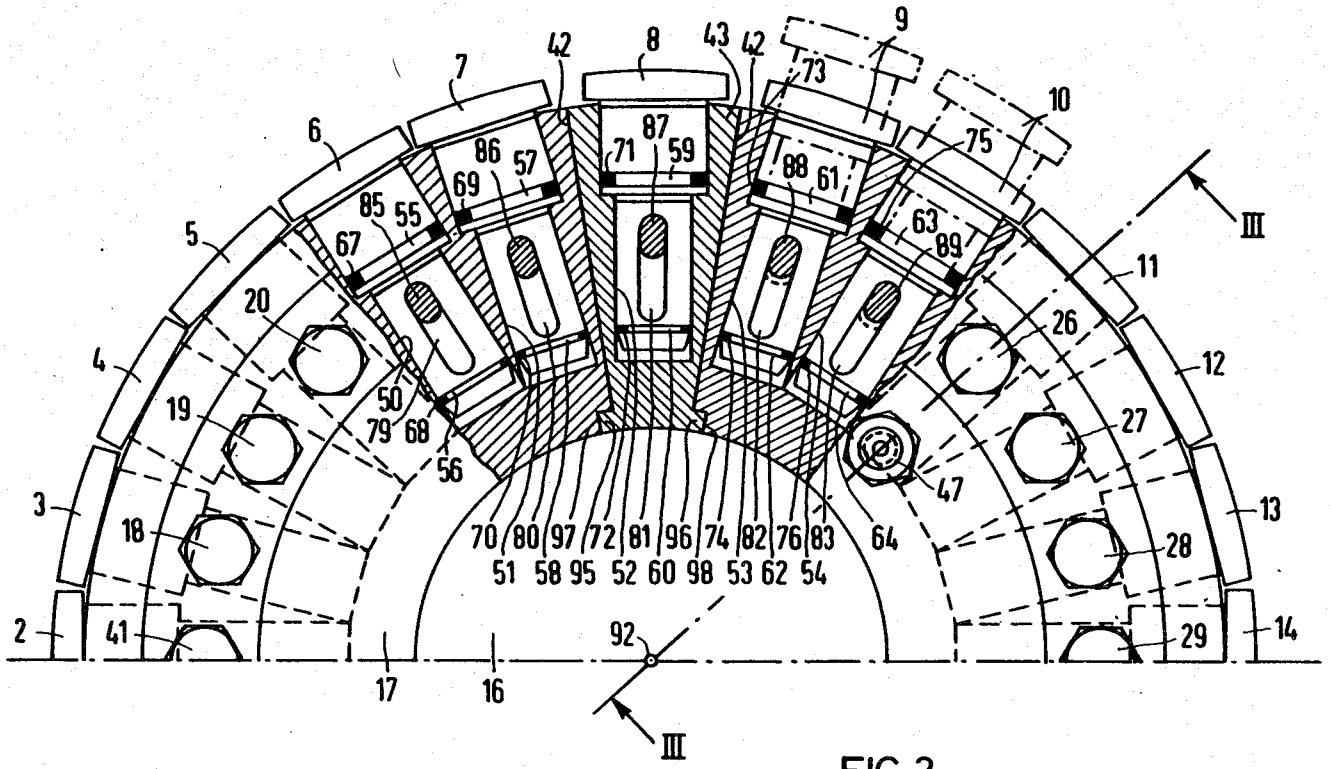
FIG. 2 is an end view of half of the end face of the flaring device of FIG. 1 shown partly broken away and partly in section.

Referring now to the drawing and first, particularly, to FIGS. 1 and 2 thereof, there are shown individual pressure plungers 2 to 14 of a flaring device 15, resting against the inside wall of a pipe end 1 to be flared out. Also, a central bore 16 of an insert 17 of the flaring device 15, carrying the pressure plungers can be distinctly seen therein. At the end face of the insert 17, adjusting screws 18 to 41 are disposed for limiting the stroke of the individual pressure plungers. As can also be seen in FIG. 2, the insert 17 is provided on the one side with a gap 42 which is approximately 20 mm wide. This gap is shown filled in FIG. 1 and in FIG. 2 by a fitting member 43. This fitting member 43 carries a protruding connecting projection 44 by which it is connectible when the fitting member 43 is inserted into the gap 42, via an hydraulic connecting plug 45 to a central hydraulic line 46 for the remaining pressure plungers extending in the insert 17. This central hydraulic line 46 can be connected via a further hydraulic plug 47 to an hydraulic supply line 48. In the FIG. 1 presentation, a further supply hose 49 is shown extending through the central bore 16 for an otherwise non-illustrated pipe-centering device which is arranged more deeply in the pipe.

Figure 3:
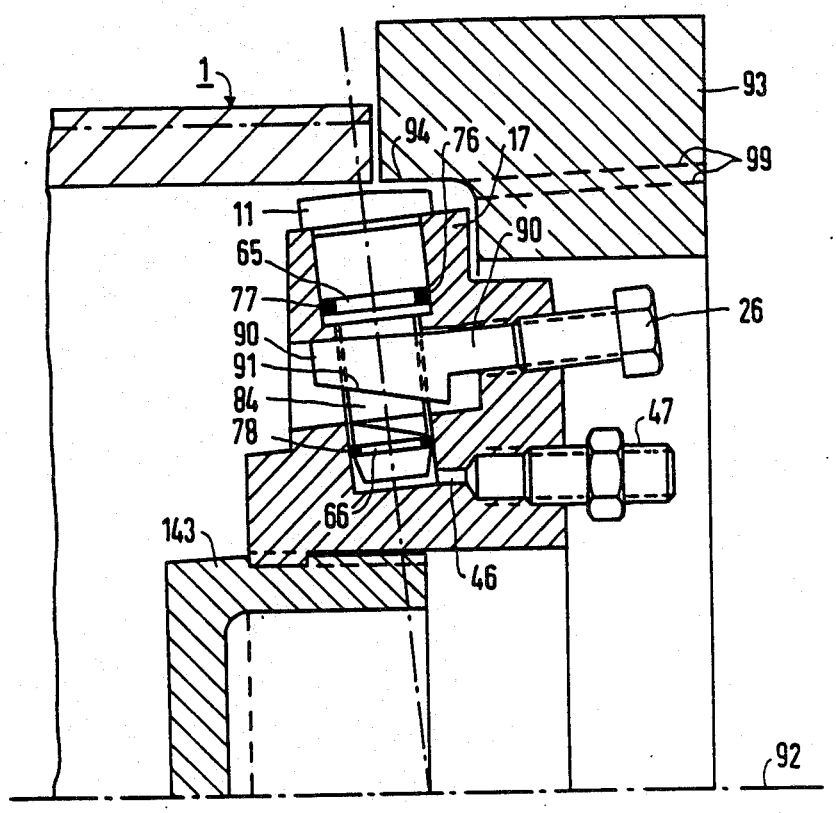
FIG. 3 is a sectional view of FIG. 2 taken along the line III—III and showing the flaring device brought to a rest in a pipe end, the section line also extending through a calibrating ring applied to the flaring device.

The internal construction of the insert 17 is best illustrated by FIGS. 2 and 3. In the broken-away half-section of FIG. 2, the pressure plungers 2 to 14 can be seen which are radially arranged at the circumference of the insert 17 and which are movable radially in holes 50 to 54 of the insert, stepped in the embodiment like a piston. These pressure plungers, the diameter of which is matched to the holes 50 to 54, have circular grooves 55 to 66, into each of which a respective O-ring 67 to 78 is inserted for sealing. FIG. 2 also shows clearly that the pressure plungers 2 to 14 have, in the smaller diameter portion thereof, a longitudinal slot 79 to 84 through which a stop pin 85 to 90 extends. Due to this stop pin, the stroke of the pressure plungers is limited in both directions. As can be seen from FIG. 3, the stop pins have a lower wedge-shaped edge 91 which has the same inclination towards the axis of symmetry of the pressure plunger as the end of the longitudinal slot 84 in the pressure plunger 11 facing towards them. The stop pin 90 can be screwed by an adjusting screw or setscrew 26 into the longitudinal slot 84 of the pressure plunger 11 to different depths as required. In addition, the hydraulic plug 47 for the central hydraulic line 46 is shown in a sectional view in FIG. 3.

From FIG. 3, it can further be seen that the pressure plungers 11 are not exactly radial but are inclined with respect to the sectional plane of FIG. 2, which is disposed perpendicularly to the symmetry axis 92 of the insert, by about 5° towards the pipe. Because the surfaces of the pressure plungers 2 to 14 facing the inner wall of the pipe end 1 to be flared, as shown in FIG. 2, have a cylindrical curvature having approximately the same radius as the inner radius of the pipe to be flared, a result thereof is that the inner edges pointing towards the interior of the pipe and facing the inner wall of the pipe are not pressed into the inner wall of the pipe when the end of the pipe is being flared. The flared contour which is attained therefore remains funnel-shaped. The stop pins 85 to 90 not only limit the maximum stroke of the pressure plungers, but also prevent them from rotating about the longitudinal axis thereof. The cylindrical convexity of the outer surface of the pressure plungers, thereby, remains aligned with the convexity of the inner wall of the pipe.

A calibrating ring 93 placed over the flaring device 15 in the cross-sectional view of FIG. 3 has a stop surface 94 which extends over the pressure plungers 2 to 14 which protrude beyond the pipe end 1 during operation. The calibrating ring 93 limits the maximum stroke of the pressure plungers 2 to 14, insofar as this limitation had not been effected before by the stop pins 85 to 90. For this purpose, the radius of the cylindrical convexity or arch of the surface portion of the pressure plungers 2 to 14 which is able to be brought into engagement with the calibrating ring 93, is swung back those five degrees relative to the axis of symmetry of the pressure plungers which swing them out of the plane oriented perpendicularly to the symmetry axis 92 of the insert 17.

Figure 4:
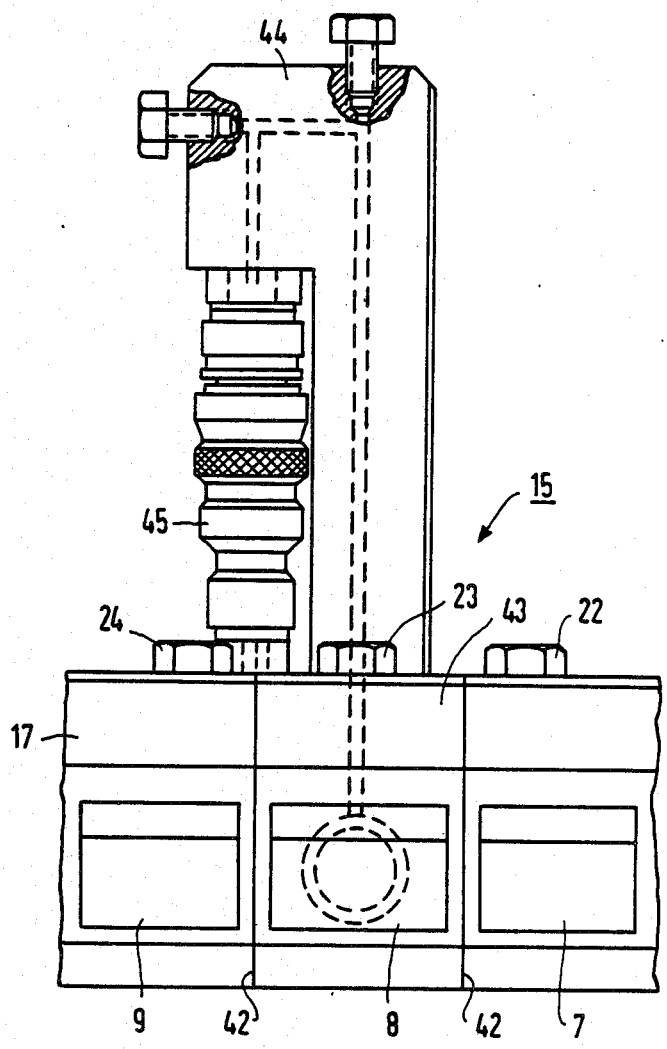
FIG. 4 is a top plan view of a side of the pipe flaring device of FIG. 1, closed by a fitting member.

FIG. 4 is a top plan view of that side of the flaring device 15 at which the gap 42 thereof is closed by the inserted fitting member 43. The fitting member 43, a sectional view of which can be seen in FIG. 2, is inserted into the gap in axial direction and is prevented from drifting off radially by a guiding edge 95, 96, which fits into a corresponding guide slot 97, 98 of the insert 17. The connecting projection 44, which is aligned parallel to the symmetry axis 92 of the insert 17, supports the hydraulic plug 45 as shown in FIG. 4. This hydraulic plug 45 fits a corresponding mating plug of the insert 17 which is connected to the central hydraulic line 46 (FIG. 3) in the interior of the insert 17.

If it is found, when thick-walled pipes are welded together, that the pipe ends to be mutually welded have different diameters or that the two pipe ends are out of line in different ways, the smaller pipe end or even both pipe ends can be flared by means of the flaring device 15 to a predetermined dimension. To this end, it is only necessary to insert the flaring device into the pipe end to be flared. If a pipe-centering device has already been inserted into this pipe end, it can remain in the pipe, and only the fitting member 43 is drawn out of the gap 42 of the insert 17, the latter being then so disposed that the gap 42 thereof is over a supply hose 49 for the pipe-centering device which is in the pipe. The fitting member 43 can then again be inserted parallel to the symmetry axis 92 of the insert 17 until the connecting plug of the central hydraulic line of the insert snaps into the hydraulic plug at the connecting projection 44 of the fitting member 43. Then the pressure plunger 8 of the fitting member 43 and the remaining pressure plungers, as well, are connected to the central hydraulic line 46 of the insert 17.

With the insert 17 inserted into the end of the pipe, the pressure plungers 2 to 14 are pressed against the inner wall of the pipe end 1 to be flared by increasing the hydraulic pressure with the aid of a non-illustrated hand pump. Attention must be given, in this regard, to the fact that the pressure plungers protrude approximately half-way from the end of the pipe in axial direction. The calibrating ring 93 is placed over the protruding pressure plungers. When the end of the pipe is being flared, this ring 93 limits the stroke of the pressure plungers and assures that the edge of the pipe end is flared or expanded on a circular radius. The flaring process no longer presents problems to the operating personnel because, if the hydraulic system is pumped up by hand, a distinct resistance is felt as soon as the pressure plungers make contact not only with the pipe wall but also additionally with the calibrating ring 93. Due to the multiplicity of pressure plungers which are used, twenty-three plungers in the embodiment of the instant application, and due to the stiffness or rigidity of the calibrating ring 93 which has a much greater wall thickness, a completely round flaring of the pipe end 1 is assured.

Instead of the calibrating ring 93, however, the stroke of the pressure plungers can be limited by moving the stop pins 85 to 90 individually and is parallel with the symmetry axis 92 of the insert 17 in such a manner that the desired flaring contour is obtained even without a calibrating ring. Also in this case, the hydraulic pressure and the pumping resistance, respectively, increase as soon as the respective inner walls of longitudinal slots 79 to 84 come to a stop at the respective stop pins 83 to 90. This is a clear sign of the completion of the flaring operation. When a calibrating ring 93 is used, as shown in FIG. 3, the exact contact of the individual pressure plungers 2 to 14 at the inner wall of the pipe and at the calibrating ring, respectively, can also be monitored visually through observation holes 99 (FIG. 3) which are worked or sunk into the end face of the calibrating ring 93, as required, and which are aligned approximately parallel to the symmetry axis of the latter.

Figure 5:
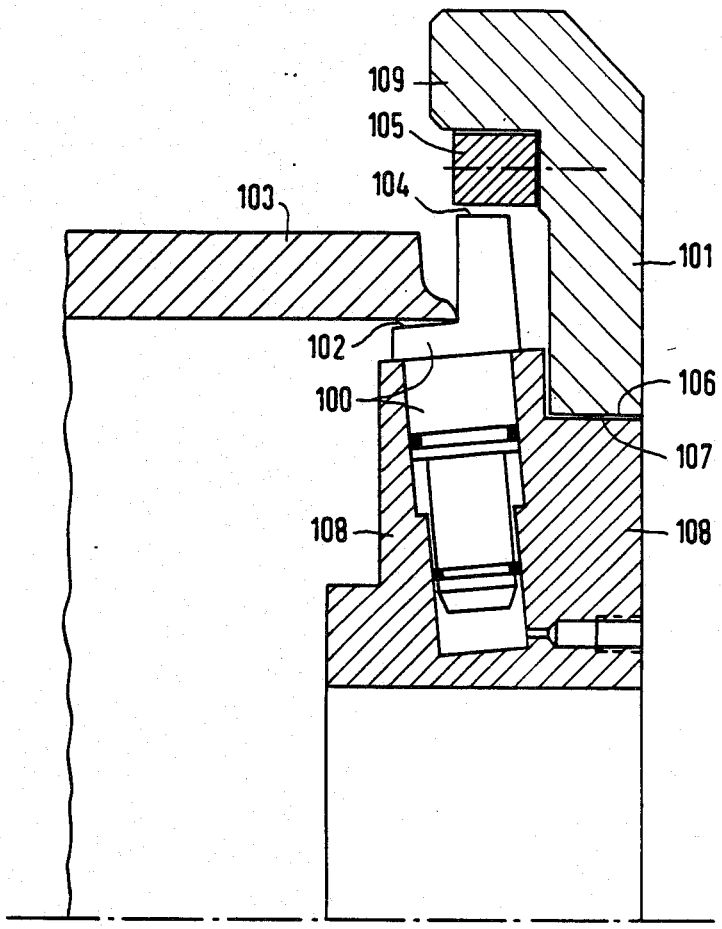
FIG. 5 is a sectional view of another embodiment of the flaring device according to the invention taken along the line of symmetry thereof and through a pressure plunger.

An especially practical construction for a pressure plunger 100, by which the contact of the latter with the calibrating ring 101 is made more readily observable, is shown in FIG. 5. The outer perimeter of the pressure plunger is L-shaped, with a seating surface 102 for making contact with the pipe end 103 and an end face 104 for making contact with the calibrating ring 101. The difference in height between the seating surface 102 and the face 104 is equal to or greater than the maximum pipe wall thickness which can be flared with this pressure plunger. While the seating surface of the pressure plunger 100 is intended for making contact with the pipe end 103 to be flared, the end face 104 is intended, respectively, for making contact with the calibrating ring 101 and for making contact with an insert ring 105 which can be inserted into the calibrating ring. The seating surface 102 and the end face 104 of the pressure plunger 100 are curved or arched cylindrically in accordance with the radius of the inner wall of the pipe and the insertion ring, respectively. The calibrating ring 101 per se carries an inner circular shoulder 106 which fits into a corresponding ring shoulder 107 of the insert 108. Insertion rings 105 of the same outer diameter but different thickness can be placed into the outer circular shoulder 109 of the calibrating ring 101.

If a pressure plunger 100 constructed in this manner is used, the contact of the individual pressure plungers of the flaring device with the pipe end 103 and at the circular outer shoulder 109 of the calibrating ring 101, respectively, during the flaring or widening of the pipe end, can be observed also visually without any problem. If all pressure plungers rest, respectively, against the insertion ring 105 and against the outer circular shoulder 109 of the calibrating ring 101, the pipe end 103 is flared to the desired diameter provided that the springback effect has been taken into consideration in the diameter of the calibrating ring. Further measuring then becomes unnecessary. By guiding the calibrating ring 101 with its inner circular shoulder 106 at the contact ring or ring shoulder 107 of the insert 108, a centered flaring is imposed upon the insert. This is advantageous particularly if this insert, in turn, is coupled centrically to a guide 143 (FIG. 3) of a non-illustrated pipe-centering device located farther inside the pipe. This pipe centering device must then remain in the two pipe ends, after the flaring device is removed, and must be kept centered in the two pipe ends until the welded seam is sufficiently strong. In this case, centered flaring is forced or imposed also in the case of out-of-round pipes and pipes with non-uniform wall thickness. The use of different insert rings 105 makes it possible, with one and the same calibrating ring 101, to effect flarings or widenings of different magnitude of a pipe end 103 by varying or changing the insert rings 105, and to flare to a given dimension pipe ends which are of different width, respectively. Through the additional use of several sets of pressure plungers 100 of different length, the range of application of the flaring device can be enlarged considerably with one and the same insert 108 and one and the same calibrating ring 101 as well as with one set of insert rings 105 of different inner diameter. This can also be achieved by constructing the pressure plungers 122 in two parts, as is shown in FIG. 8, and replacing the part 144 of the pressure plunger which is able to be brought into contact with the pipe by one such part having a different height.

Figure 6:
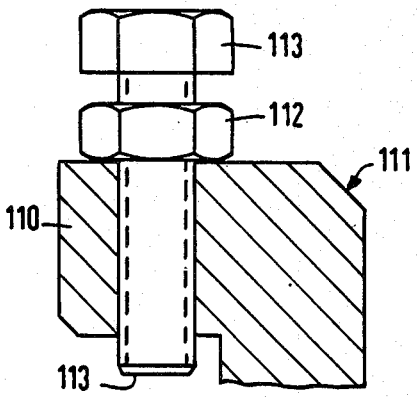
FIG. 6 is a sectional view taken through the contact surface for the pressure plungers of a calibrating ring modified with respect to the embodiment of FIG. 5.

FIG. 6 is a sectional view of the circular outer shoulder 110 of a different calibrating ring 111, in which the stop dimension is determinable by using individually adjustable stop screws 113 which can be secured by lock nuts 112, instead of insert rings of suitable inner diameter. This calibrating ring 111 can also be used for special problems, in which an extent of flaring which varies over the circumference is desired. In addition, the same flaring problems which can be solved also with the calibrating ring 101 and with an insert ring 105 in accordance with the embodiment of FIG. 5, can be solved. Resetting of this calibrating ring 111 from one flaring diameter to a new flaring diameter is considerably more costly, however, than for a calibrating ring according to FIG. 5 because it is necessary to measure the width between the individual stop screws 113, only the insert ring 105 having to be exchanged in the embodiment of FIG. 5.

Figure 7:
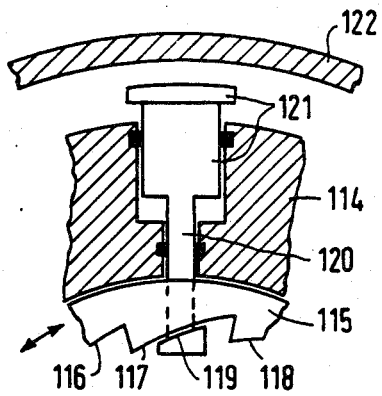
FIG. 7 is a cross-sectional view taken through part of a flaring device according to the invention with a calibrating ring arranged in the interior of the insert.

FIG. 7 shows a section of another insert 114, such as is indicated for flaring devices for especially large pipe diameters. In this case, the calibrating ring 115 is in the interior of the insert. At the inner circumference thereof, the ring 115 carries sawtooth-shaped, obliquely set surface parts 116 to 118. These are able to be brought into engagement with correspondingly inclined surface elements 119 by projections 120 from the individual pressure plungers 121 extending to the inside. There, the maximum stroke of the pressure plunger 121 and the maximum flaring dimension of the pipe 122 determined thereby are established by the rotational position of the calibrating ring 115 in the insert 114. With this device, the stroke of the pressure plungers can be changed especially rapidly. With this insert 114, there is also the possibility of retracting the pressure plungers 121 to the starting position thereof by turning or twisting the calibrating ring 115 after the flaring process has been completed. The first-time setting of this calibrating ring can be accomplished exactly, quickly and simply by pressing the pressure plungers 121 against a calibrating ring 101 (FIG. 3) with an insert ring 105 selected accordingly, and then turning the inner calibrating ring 115 until it makes contact with the inclined surface element 119 of the projections 120, and locking it in this position.

Figure 9:
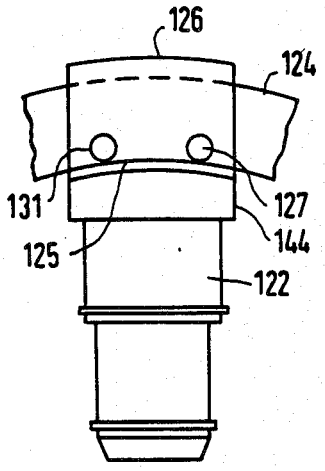
FIG. 9 is another view of the pressure plunger of FIG. 8 rotated through 90°.
Figure 8:
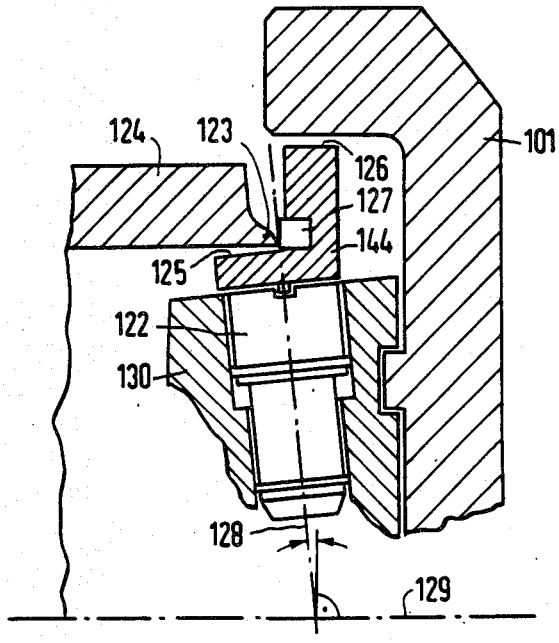
FIG. 8 is a longitudinal sectional view taken through a pressure plunger of a flaring device, with countersunk elastic spacers for the welding lip.

FIGS. 8 and 9 show a pressure plunger 122 with L-shaped cross section similar to the pressure plunger shown in FIG. 5. For protecting the welding lips 123 of the pipe end 124 in the angular corner between a seating surface 125 and a side or flank leading to the end face 126, a plastic plug 127 is inserted. This construction is advantageous especially for centered flaring relative to the pipe according to FIG. 3, if the flaring device is coupled to a pipe centering device clamped in the non-illustrated pipe and consequently also can no longer give or yield axially with respect to the pipe. In this case, due to the inclination of the pressure plunger axes 122 relative to the perpendicular to the symmetry axis 129 of the insert 130, upsetting forces are generated at the forward edges of the pipe end 124, which can lead to damage to the welding lip 123. The forces exerted thereat axially on the edge of the pipe can be intercepted by this yielding or resilient plastic plug 127. As shown in FIG. 9, it is of special advantage, in this regard, to arrange two plastic plugs 127, 131 side-by-side for each pressure plunger 122. Rotation of the pressure plunger 122 about its longitudinal axis 128 is thereby prevented, and assurance is thereby provided that the pressure plunger cannot produce an impression with its lateral edges upon the welding lip 123.

Figure 10:
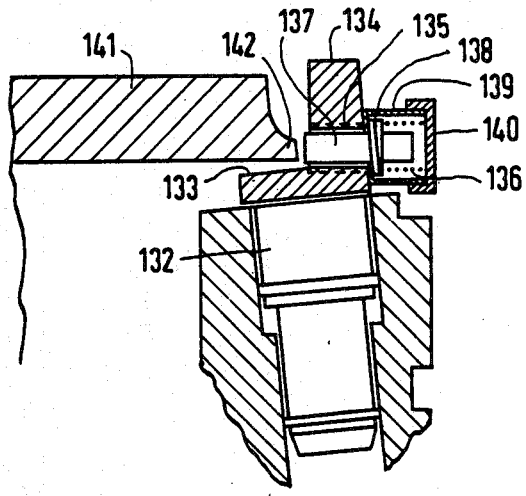
FIG. 10 is a sectional view taken through another spacer for the welding lip.

FIG. 10 shows another embodiment of the pressure plunger structure of FIGS. 8 and 9. There, the pressure plunger 132 is drilled in the vicinity of the angle thereof between the seating surface 133 and the flank or leg leading to the end face 134, and round material 137 is inserted which is forced towards the seating surface by a compression spring 136. This round material has a very wide collar 138 which limits any protrusion of the round material on the side of the seating surface 133 to a few millimeters. On the side of the hole 135 facing away from the seating surface, a bushing 139 is welded-on. It is provided with a screw lid 140, against which the compression spring 136 is braced. The round material 137 can be pressed back against the force of the compression spring 136 when the axial upsetting forces at the forward edge of the pipe end are increased and can thus save the welding lip 142 from damage in a manner similar to the plastic plugs 127, 131 of the embodiment of FIGS. 8 and 9.

The foregoing is a description corresponding in substance to German Application P No. 34 08 070.8, dated Mar. 5, 1984, the International priority of which is being claimed for the instant application, and which is hereby made part of this application. Any material discrepancies between the foregoing specification and the aforementioned corresponding German application are to be resolved in favor of the latter.

We claim:

1. Flaring device for pipe ends including an insert member centrally insertable into a pipe end, the insert member having mounted thereon synchronously operable pressure plungers arranged at the outer circumference thereof and bringable into engagement with the inner circumference of the pipe end to be flared, comprising means connected to the device for actuating the pressure plungers, a calibrating ring operatively engaging the insert member and engageable by each of the pressure plungers for determining a maximum radially outward disposition of the pressure plungers mounted on the insert member, the pressure plungers being oriented radially with respect to the insert member so as to define a maximum outer circumference, said calibrating ring having individually adjustable stops at the outer circumference thereof, said pressure plungers being disposed, respectively, opposite said stops and being engageable thereby.

2. Flaring device according to claim 1 wherein said calibrating ring has a portion thereof extending axially of said insert member and surrounding parts of each of the pressure plungers for determining a maximum radially outward position of the pressure plungers during expansion thereof and, the pressure plungers are bringable into direct contact, at said outer circumference defined thereby, with said calibrating ring, and with the inner circumferential surface of the pipe.

3. Flaring device according to claim 1 wherein said calibrating ring is a ring having a circular outer shoulder formed thereon and projecting partially over the pressure plungers.

4. Flaring device according to claim 1 wherein said calibrating ring has means for receiving therein insert rings of varying inner diameters.

5. Flaring device according to claim 4 including means for fastening said calibrating ring on said insert member in centered relationship therewith.

6. Flaring device according to claim 1 wherein said stops comprise respective setscrews lockable by respective lock nuts.

7. Flaring device according to claim 1 wherein said calibrating ring is formed with bores through which contact between the respective pressure plungers and the pipe and the calibrating ring, respectively, is observable.

8. Flaring device according to claim 1 including adaptor means connected to said pressure plungers for extending the range of expansion of said pressure plungers.

9. Flaring device according to claim 8 wherein said pressure plungers are of bipartite construction, said pressure plunger having a part thereof engageable with the pipe, said part of said pressure plunger being replaceable by another such part having a different height and contour, respectively.

10. Flaring device according to claim 1 wherein said pressure plungers have outer surfaces and are curved cylindrically in accordance with the inner circumference of the pipe and of said calibrating ring, respectively.

11. Flaring device according to claim 1 wherein said pressure plungers in said insert member are inclined towards the pipe by up to 10° with respect to a plane oriented perpendicularly to the axis of the device.

12. Flaring device according to claim 1 wherein said pressure plungers have L-shaped outer surfaces, an inner shoulder of which is engageable with a surface of the pipe and an upper end face with said calibrating ring.

13. Flaring device according to claim 1 wherein said insert member is of hollow cylindrical construction.

14. Flaring device according to claim 13 wherein said insert member is formed with at least one radially extending gap 10 mm wide, and including a removeable fitting member closing said gap.

15. Flaring device according to claim 14 wherein said fitting member is positively locked in said gap, secured against radial displacement.

16. Flaring device according to claim 14 wherein said fitting member carries at least one of said pressure plungers, and said one pressure plunger is connectible to a supply line of the other of said pressure plungers.

17. Flaring device according to claim 1 wherein said insert member comprises a plurality of assemblable segments which are mutually securable against radial displacement.

18. Flaring device according to claim 17 wherein said segments of said insert member are securable against mutual, axial displacement.

19. Flaring device according to claim 1 wherein said insert member has means for centrically fastening said insert member to a pipe-centering device inserted in the pipe end to be flared.

20. Flaring device for pipe ends including an insert member centrally insertable into a pipe end, the insert member having mounted thereon synchronously operable pressure plungers arranged at the outer circumference thereof and bringable into engagement with the inner circumference of the pipe end to be flared, comprising means connected to the device for actuating the pressure plungers, a calibrating ring operatively engaging the insert member and engageable by each of the pressure plungers for determining a maximum radially outward disposition of the pressure plungers mounted on the insert member, the pressure plungers being oriented radially with respect to the insert member so as to define a maximum outer circumference, said calibrating ring being mounted within said insert member, said pressure plungers being formed with projections, respectively, by which said pressure plungers are engageable with said calibrating ring.

21. Flaring device according to claim 20 wherein said calibrating ring is adjustable relative to said insert member so as to bring regions of said calibrating ring into contact with said projections at different radial distances from an axis of symmetry.

22. Flaring device according to claim 21 wherein said projections are formed with respective shoulders engageable with an inner side of said calibrating ring.

23. Flaring device according to claim 22 wherein said calibrating ring is formed with inner surfaces which are beveled in saw-tooth manner and are engageable with respective shoulders formed on the respective projections.

* * * * *